US009410293B2

(12) United States Patent
Rodriguez Plaza et al.

(10) Patent No.: US 9,410,293 B2
(45) Date of Patent: Aug. 9, 2016

(54) HIGH-SPEED RAILWAY AERODYNAMIC SLEEPER

(71) Applicants: ADMINISTRADOR DE INFRAESTRUCTURAS FERROVIARIAS (ADIF), Madrid (ES); FUNDACION CIDAUT, Boecillo (Valladolid) (ES); SENER INGENIERIA Y SISTEMAS, S.A., Getxo-las Arenas (Vizcaya) (ES); UNIVERSIDAD POLITECNICA DE MADRID, Madrid (ES)

(72) Inventors: Miguel Rodriguez Plaza, Madrid (ES); Alvaro Mascaraque Sillero, Madrid (ES); Luis Alberto Montes Leon, Boecillo (ES); Alejandro Izquierdo de Francisco, Boecillo (ES); Manuel Rodriguez Fernandez, Getxo-las Arenas (ES); Paula Alvarez Legazpi, Getxo-las Arenas (ES); Benigno Lazaro Gomez, Madrid (ES); Ezequiel Gonzalez Martinez, Madrid (ES); Alvaro Andres Alguacil, Madrid (ES); Diana Alonso Gimeno, Madrid (ES); Santiago Del Blanco Villalba, Boecillo (ES); Angel Perena Tapiador, Getxo-las Arenas (ES); Rafael Rebolo Gomez, Getxo-las Arenas (ES); Pedro Jose Herraiz Alijas, Getxo-las Arenas (ES)

(73) Assignees: ADMINISTRADOR DE INFRAESTRUCTURAS FERROVIARIAS (ADIF), Madrid (ES); FUNDACION CIDAUT, Boecillo (Valladolid) (ES); SENER INGENIERIA Y SISTEMAS, S.A., Getxo-Las Arenas (Vizcaya) (ES); UNIVERSIDAD POLITECNICA DE MADRID, Madrid (ES)

( * ) Notice: Subject to any disclaimer, the term of this patent is extended or adjusted under 35 U.S.C. 154(b) by 102 days.

(21) Appl. No.: 14/379,054

(22) PCT Filed: Feb. 15, 2013

(86) PCT No.: PCT/ES2013/070091

§ 371 (c)(1),
(2) Date: Aug. 15, 2014

(87) PCT Pub. No.: WO2013/121069

PCT Pub. Date: Aug. 22, 2013

(65) Prior Publication Data

US 2015/0028121 A1 Jan. 29, 2015

(30) Foreign Application Priority Data

Feb. 17, 2012 (ES) ..... 201230248

(51) Int. Cl.
*E01B 3/00* (2006.01)
*E01B 3/28* (2006.01)
*E01B 3/44* (2006.01)

(52) U.S. Cl.
CPC ... *E01B 3/28* (2013.01); *E01B 3/00* (2013.01); *E01B 3/44* (2013.01)

(58) Field of Classification Search
CPC ..... E01B 3/32; E01B 3/34; E01B 3/36; E01B 3/38; E01B 3/40; E01B 3/42; E01B 3/00; E01B 3/16; E01B 3/18
See application file for complete search history.

(56) References Cited

U.S. PATENT DOCUMENTS 1,747,417 A * 2/1930 Billups ..... E01B 3/36 238/31

(Continued)

FOREIGN PATENT DOCUMENTS

ES 2 016 883 12/1990
GB 536121 5/1941

(Continued)

OTHER PUBLICATIONS

International Search Report issued Sep. 30, 2013 in corresponding International Application No. PCT/ES2013/070091.

(Continued)

*Primary Examiner* — Jason C Smith
(74) *Attorney, Agent, or Firm* — Wenderoth, Lind & Ponack, L.L.P.

(57) ABSTRACT

A high-speed railway aerodynamic sleeper (1) including one central area (2), two support areas (3) on each side of the central area (2), on which the rails are placed, and two outer areas (4), located at the ends of the sleeper (1), following the support areas (3). The cross-section of the sleeper (1) includes, on the central area (2), and the support areas (3), and the two outer areas (4), a first bottom section (5) comprising a first polygon (7) having at least 4 sides and a second top section (6) having at least one second polygon (8) of n sides, n being≥4, the first bottom section (5) and the second top section (6) being attached to each other, and the top base (10) of the first polygon (7) and the bottom base (9) of the second polygon (8) share their sides.

7 Claims, 10 Drawing Sheets

(56) References Cited

U.S. PATENT DOCUMENTS

| | | | | | |
|---|---|---|---|---|---|
| 2,517,810 | A * | 8/1950 | Taylor | E01B 3/18 | 238/35 |
| 2,538,443 | A * | 1/1951 | Delvaux | E01B 3/36 | 238/117 |
| 3,091,203 | A | 5/1963 | Usab | | |
| 4,453,488 | A | 6/1984 | Watchorn | | |
| 5,551,631 | A * | 9/1996 | Cailliau | E01B 1/00 | 238/109 |
| 5,645,216 | A * | 7/1997 | Benenowski | E01B 9/42 | 238/283 |
| 2005/0252985 | A1* | 11/2005 | Braithwaite | E01B 1/004 | 238/105 |
| 2006/0124760 | A1* | 6/2006 | Markus | E01B 1/002 | 238/2 |
| 2008/0230621 | A1* | 9/2008 | Bogl | E01B 1/002 | 238/25 |
| 2009/0217854 | A1 | 9/2009 | Rytand et al. | | |
| 2014/0183271 | A1* | 7/2014 | Hughes | E01B 1/008 | 238/2 |
| 2015/0028121 | A1* | 1/2015 | Rodriguez Plaza | E01B 3/28 | 238/35 |
| 2015/0308051 | A1* | 10/2015 | De Lisi | E01B 3/36 | 238/85 |
| 2015/0330031 | A1* | 11/2015 | Van Erp | E01B 3/44 | 238/115 |
| 2016/0002863 | A1* | 1/2016 | Romero | E01B 1/004 | 238/85 |

FOREIGN PATENT DOCUMENTS

| | | | |
|---|---|---|---|
| GB | 706587 | 3/1954 | |
| GB | 791578 | 3/1958 | |
| GB | 1 354 299 | 5/1974 | |
| WO | 2005/100691 | 10/2005 | |
| WO | WO 2005100691 A1 * | 10/2005 | E01B 3/32 |
| WO | 2007/032701 | 3/2007 | |
| WO | 2008/048095 | 4/2008 | |

OTHER PUBLICATIONS

Written Opinion of the International Searching Authority (in English) issued Sep. 30, 2013 in corresponding International Application No. PCT/ES2013/070091.

* cited by examiner

HIGH-SPEED RAILWAY AERODYNAMIC SLEEPER

BACKGROUND OF THE INVENTION

1. Technical Field

The present invention is related to a sleeper, the design of which has a double objective: the reduction of the aerodynamic load produced by the passage of the train on the ballast bed, as well as the prevention of the ballast particles from being deposited on the sleeper. In this way, the likelihood of the occurrence of the ballast lifting phenomenon is reduced. The invention is applicable in the railway field; it especially applies in the construction and renovation of railway tracks through which high speed railway vehicles run.

2. Description of the Related Art

Of the elements that make up the track, the sleepers perform different functions in the track in which they are placed, including: the transmission of dynamic stress generated during the transit of railway vehicles, they fix the rails on their place of use, they keep the distance between the rails constant (the width of the track), they preserve the runway and dampen the vibrations of the rail and the acoustic impact on the environment.

The evolution of the materials forming the sleeper has been constant, starting from a sleeper that was constituted by wood, passing through sleepers constituted by two concrete pieces joined together by a metallic element and coming to a sleeper consisting exclusively of concrete, which is the one currently used in the construction of railway tracks.

In the configuration of a track built on ballast, in addition to the electrification and safety systems, the area of the track on which the railway vehicle is supported is made up of rails, sleeper and ballast.

The ballast is the stone material on which the sleepers are placed and that, as well as acting as a support for the sleepers, is used to wrap said sleepers and prevent the lateral movement of the sleepers.

The development of high speed in the circulation of trains has resulted in the occurrence of a series of phenomena that did not occur in the movement of trains at conventional speeds.

One of the new phenomena is ballast lifting. This phenomenon occurs with the movement of the railway vehicle at high speed which, due to the speed of the air that the railway vehicle moves in its movement, transmits a thrust to the stones forming the ballast layer that makes the stones rotate and move, sometimes colliding with the bottom of the train. When the collision takes place, the stone of the ballast is thrown producing collisions with other stones, with the rail, with the sleepers or with other elements of the railway superstructure.

In order to try to prevent the ballast lifting phenomenon, the improvement of the aerodynamic conditions is a key feature, as much from of the train as from the track.

For the improvement of the aerodynamic conditions of the track, the shape of the sleeper is an important factor, which significantly affects the speed of the wind over the ballast bed, thus being a parameter relevant to the ballast lifting phenomenon.

In the realisation of a track, once the platform on which the track will be placed is built, the steps followed are:

- a ballast layer (stone material) is placed,
- the sleepers are placed on said ballast layer, and
- the rails on which the train will move are placed and attached to said sleepers.

Once the ballast, the sleepers and the rails are placed, the rails are placed in their final position with specialized track mounting equipment (the level is changed and they are moved laterally when necessary), carrying out, at the same time, the wrapping up of the sleepers with ballast, obtained from the one placed first or from a new contribution. The action of wrapping up the sleepers with ballast results in the sleeper being embedded inside the ballast, sticking out only a part of the sleeper (upper faces of the sleeper). The shape of the sleeper, in particular of the part of the sleeper that sticks out from the ballast when the track is ready for the movement of trains, has a significant influence on the ballast lifting phenomenon.

GB 706587 discloses a sleeper consisting of two concrete elements on which the rails are located, connected by a metal piece with different sections; ES 2016883 A6 discloses a sleeper that can be adapted to the two different track widths existing in Spain through a metal piece, by rotating the metal piece, and said piece is attached to the sleeper.

SUMMARY OF THE INVENTION

The present invention discloses a new sleeper to be installed in the railway lines that support vehicles at high speed, which helps to reduce the aerodynamic load of the train on the track, thus decreasing the likelihood of the occurrence of the ballast lifting phenomenon.

The high-speed railway aerodynamic sleeper comprises one central area, two support areas, on each side of the central area, on which the rails are placed, and two outer areas, located at the ends of the sleeper and following the support areas.

The cross-section of the sleeper comprises in the central area, in the support areas and in the two outer areas two solid sections:

- a first bottom section, comprising a first polygon of at least 4 sides, and
- a second top section, comprising at least one second polygon with "n" sides, with $n \geq 4$.

The first bottom section and the second top section on the sleeper are attached, and their sides share the top base of the first polygon and the bottom base of the second polygon.

In the sleeper, the central area comprises one middle sector that constitutes the center of the sleeper, and two end sectors located at both sides of the middle sector of the central area of the sleeper.

The cross-section of the sleeper comprises at the second top section of the middle sector only one second polygon in which the number of sides "n" is comprised between 4 and infinity, such that by means of the geometry of the sleeper, the speed of the wind over the ballast bed in the area between sleepers is reduced.

On the high-speed railway aerodynamic sleeper the number of sides "n" of the second polygon tends to infinity in the middle sector of the central area, having a conic section profile.

On the high-speed railway aerodynamic sleeper being the number of sides of the second polygon "n" equal to 4, the cross-section of the sleeper, at the end sectors of the central area, comprises a third polygon located over the second polygon, the third polygon having "m" sides, with $m \geq 4$.

At the end sectors of the central area of the sleeper, the number of sides "m" of the third polygon tends to infinity, having a conic section profile.

The conic section profile of the second polygon and of the third polygon, comprises circular section profile, parabolic section profile, hyperbolic section profile and ellipsoidal section profile.

At the top section, the top sides of the second polygon of the middle sector of the central area are a continuation of the top sides of the third polygon at the end sector of the central area, having continuity at the outer surface offered by the third polygon and the second polygon.

On the high-speed railway aerodynamic sleeper when the number of sides "n" of the second polygon equal to 4 in the middle sector of the central area, the length of the top side of the second polygon is less than or equal to half the length of the bottom base of the second polygon.

On the high-speed railway aerodynamic sleeper there is, longitudinally, a line that marks a transition between the first bottom section and the second top section and the inclination of which varies according to its position on the three areas of the sleeper, said sleeper offering continuity at the outer surface.

The railway sleeper is made of a material to be selected from concrete, fiber or composite materials.

BRIEF DESCRIPTION OF THE DRAWINGS

The invention is complemented, for an easy understanding of the description that is being carried out, with a set of drawings in which with illustrative character and without limitation, the following has been represented.

Below is a list of the different elements represented in the figures that make up the invention:

1.—sleeper,
2.—central area,
2*a*. middle sector,
2*b*. end sector,
3.—support area,
4.—outer area,
5.—first bottom section,
6.—second top section,
7.—first polygon,
8.—second polygon,
9, 9'. top base,
10, 10'. bottom base,
11. line,
12. third polygon,
13. rails,
14, 14'. top side.

DETAILED DESCRIPTION OF AN EMBODIMENT OF THE INVENTION

The invention discloses a new sleeper (1) developed especially for use in tracks on which there is circulation of high speed trains.

Figure 3:
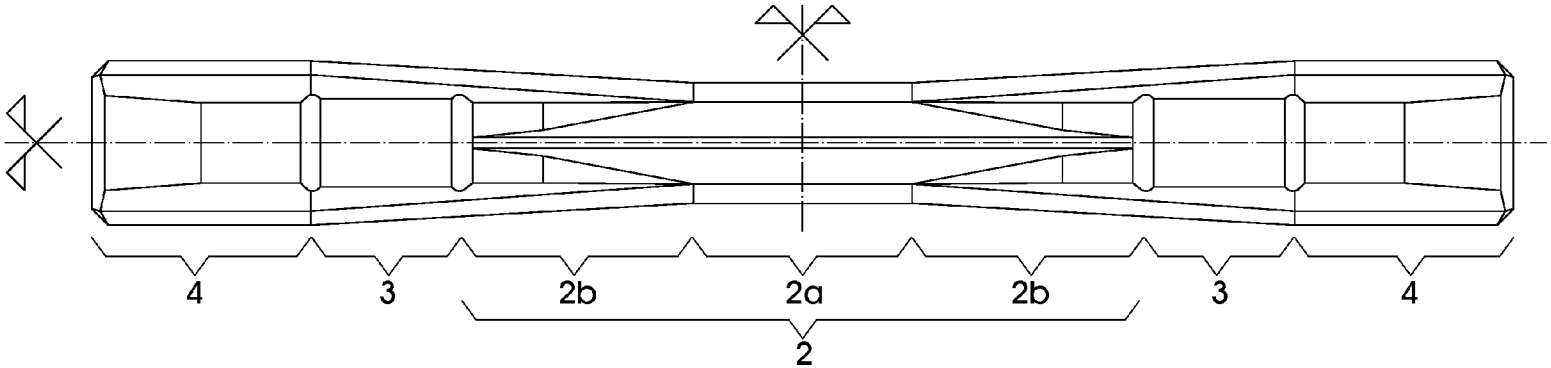
FIG. 3 is a plan view of the sleeper according to the embodiment of FIG. 1.
Figure 4:
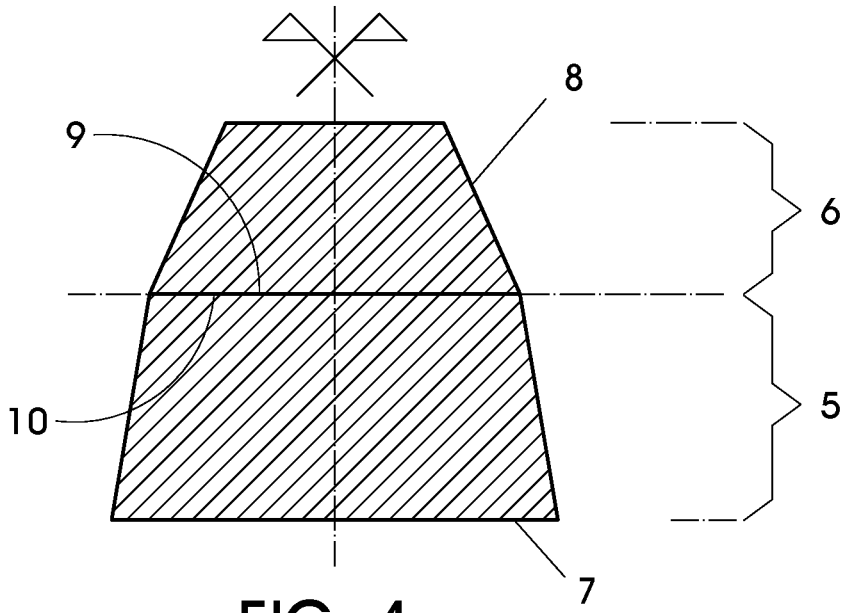
FIG. 4 is a view of a cross section carried out on the outer area of the sleeper according to the first embodiment.
Figure 5:
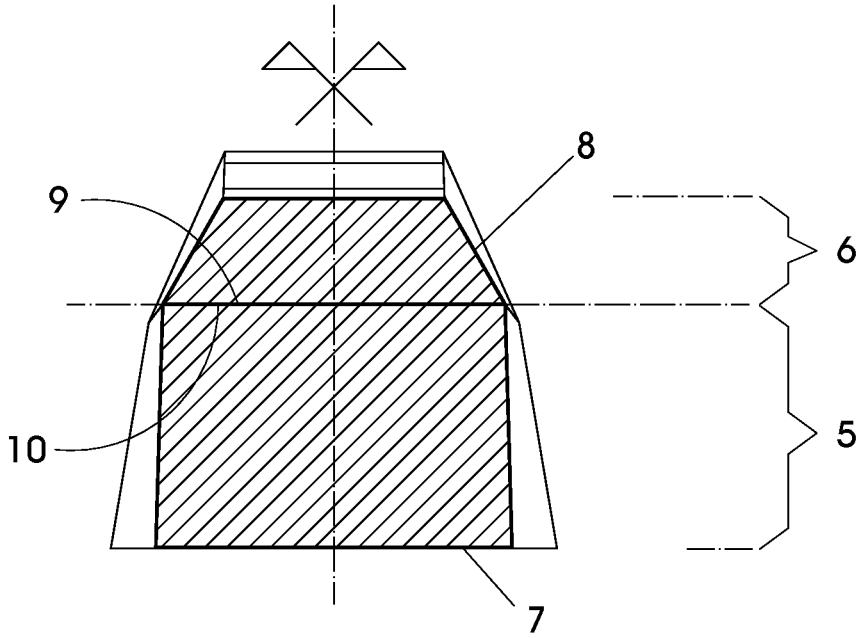
FIG. 5 is a view of a cross section carried out on the support area of the sleeper according to the first embodiment.
Figure 6:
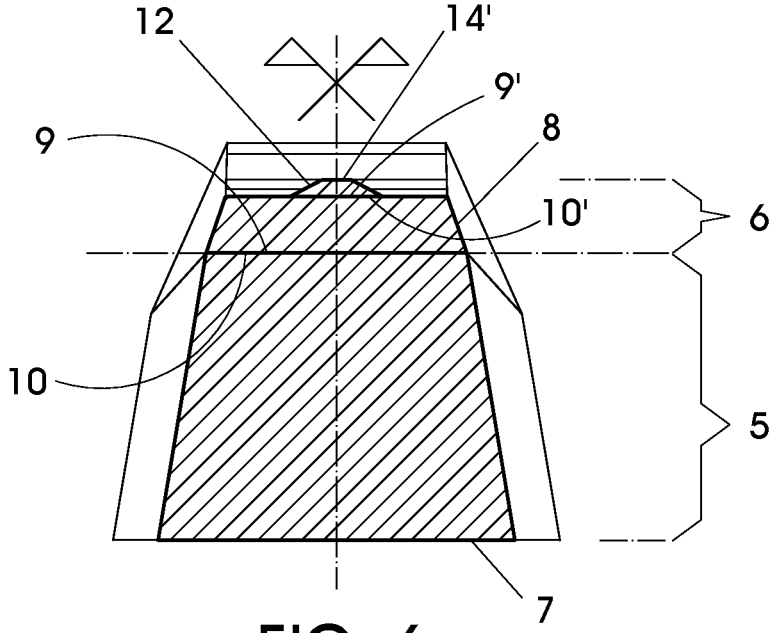
FIG. 6 is a view of a cross section carried out on the end sector of the central area of the sleeper according to the first embodiment.
Figure 10:
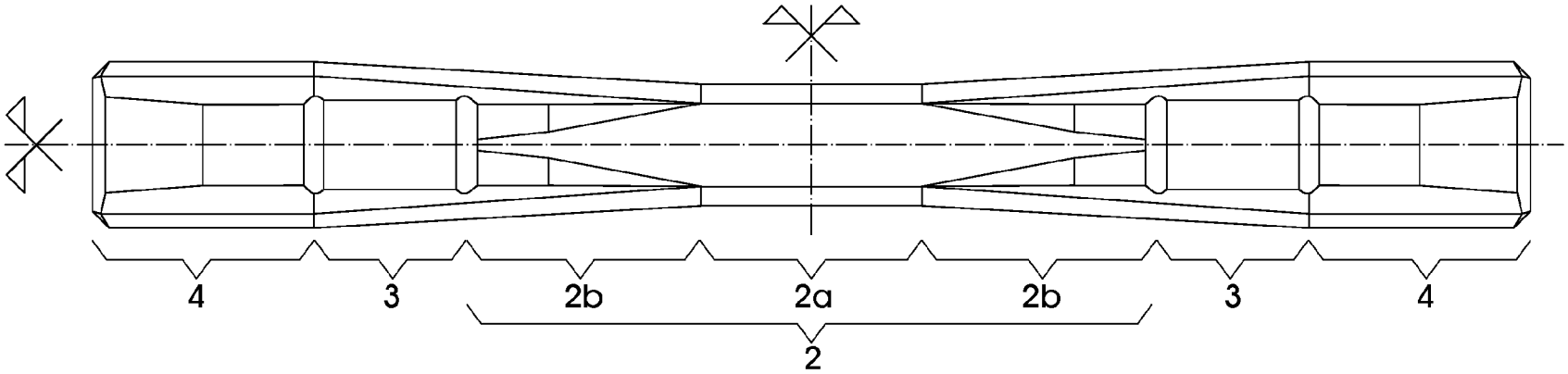
FIG. 10 is a plan view of the sleeper according to the embodiment of FIG. 8.
Figure 11:
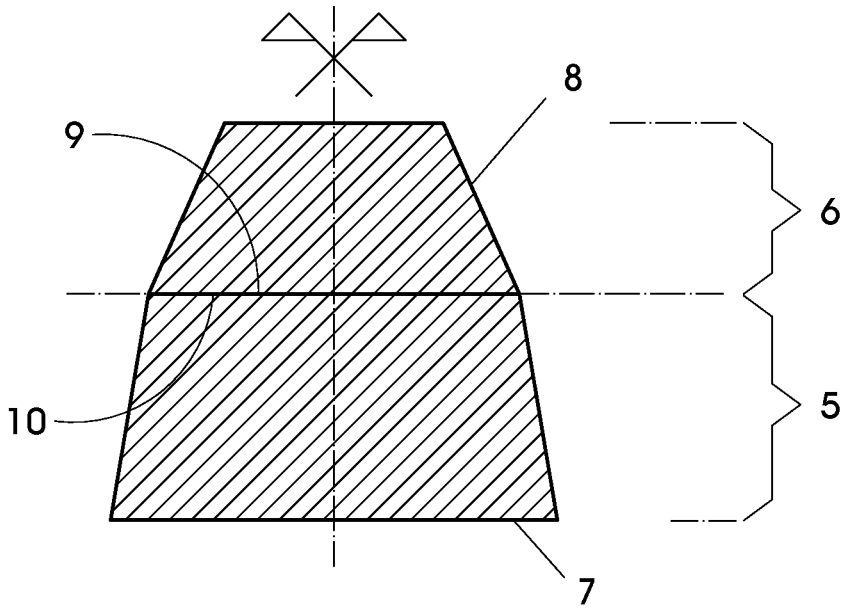
FIG. 11 is a view of a cross section carried out on the outer area of the sleeper according to the second embodiment.
Figure 12:
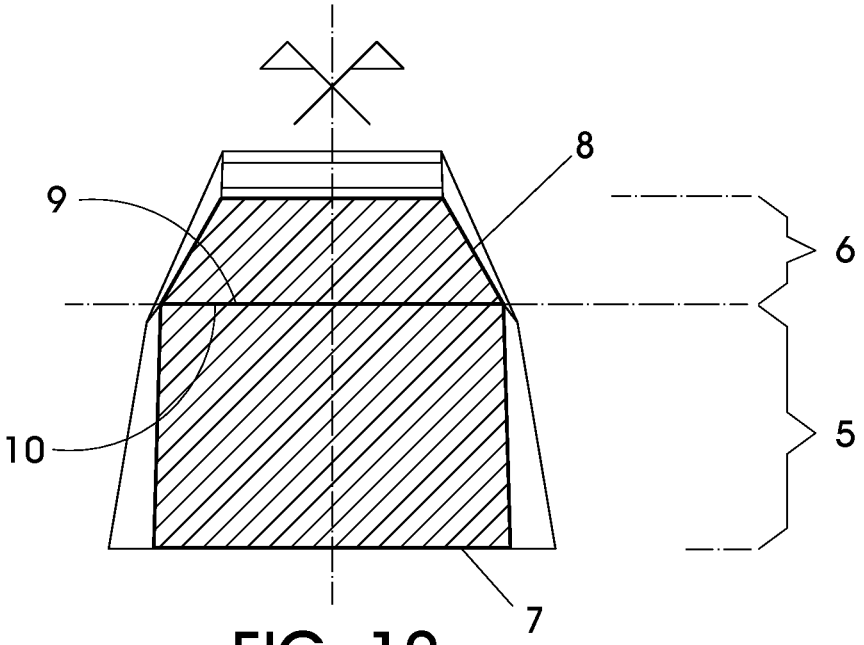
FIG. 12 is a view of a cross section carried out on the support area of the sleeper according to the second embodiment.
Figure 13:
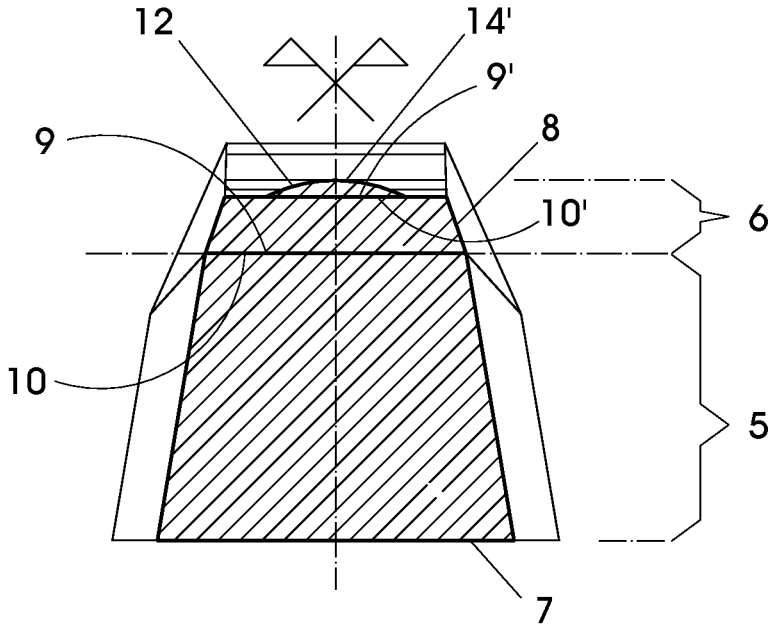
FIG. 13 is a view of a cross section carried out on the end sector of the central area of the sleeper according to the second embodiment.

The sleeper (1) of the invention has a doubly symmetric geometry since it is longitudinally and transversally symmetric with respect to planes that pass through the center of the sleeper (1). The planes are perpendicular to the plane of the drawing, as shown in FIGS. 3 and 10, and pass through the axes indicated in the cited figures.

Figure 1:
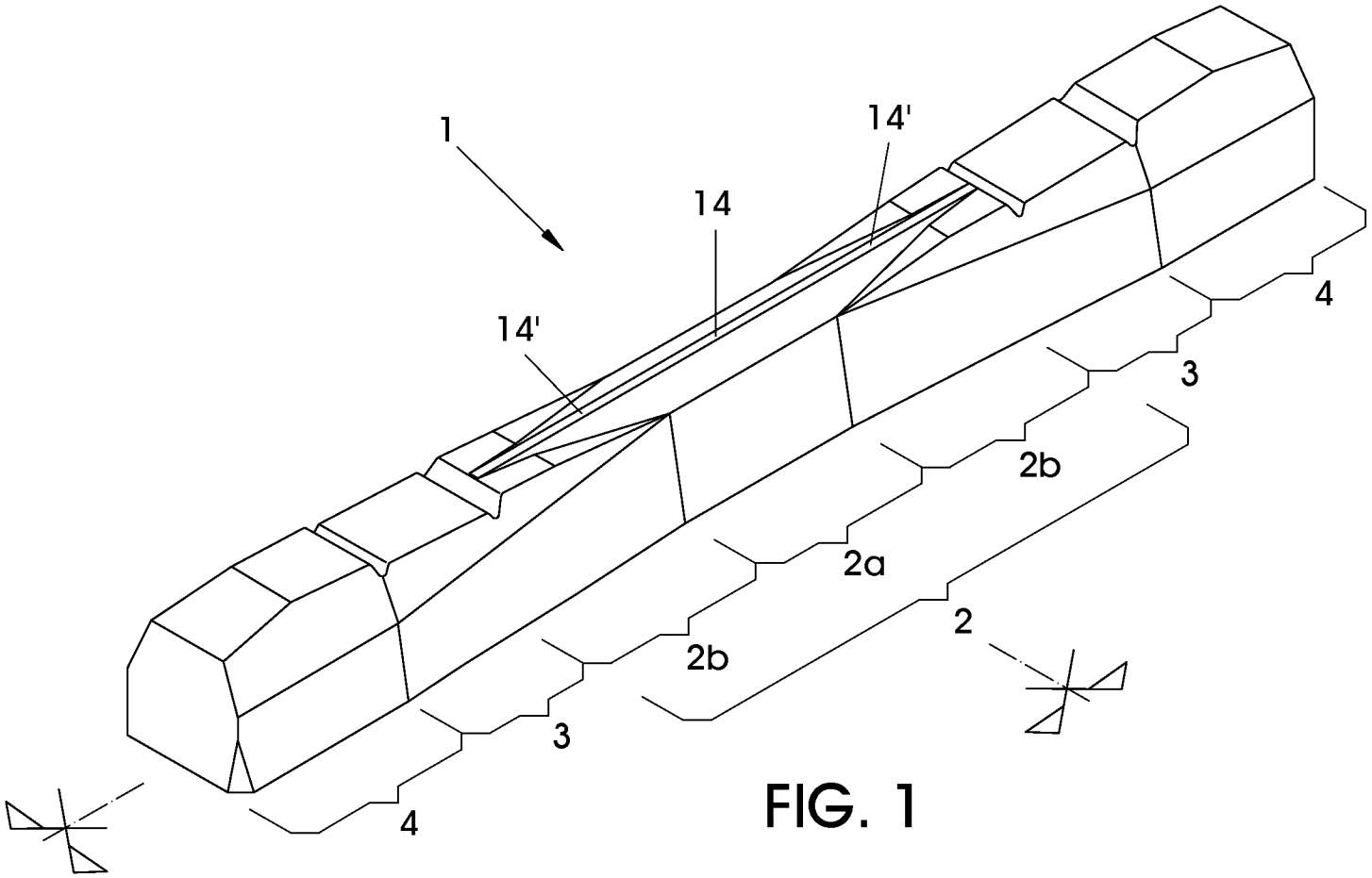
FIG. 1 is a perspective view of a first embodiment of the invention.
Figure 8:
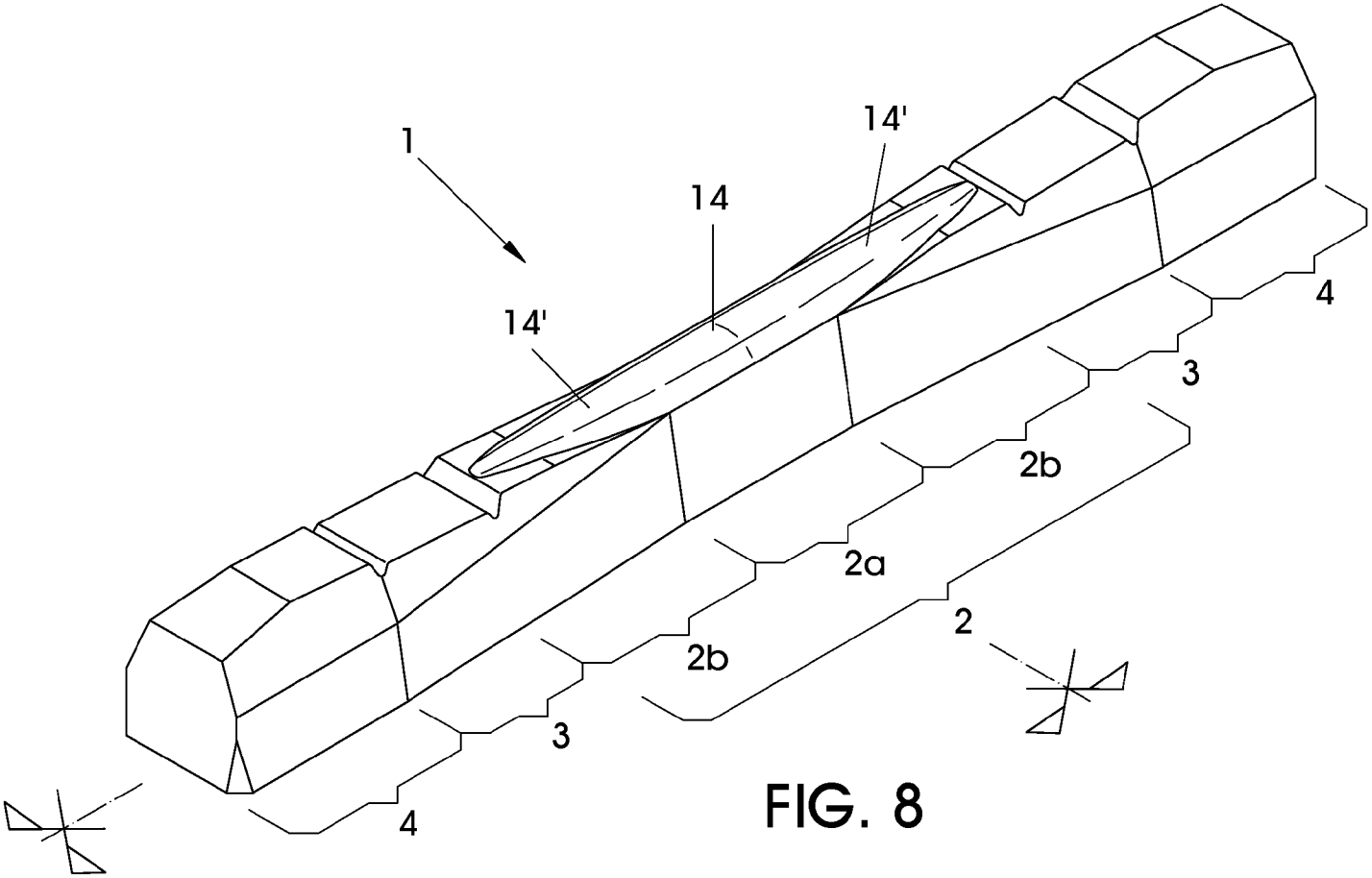
FIG. 8 is a perspective view of a second embodiment of the invention.

The perspective view of FIGS. 1 and 8, in which the two embodiments of the sleeper (1) of the invention are shown, shows the geometry of the sleeper (1), in which three areas can be identified:

- one central area (2), having two different cross sections that give rise to the two embodiments of the invention.
- at the sides of the central area (2) there are two support areas (3), that will serve as a support for the rails (13), being equal in the two embodiments of the invention, and
- next, two outer areas (4) are located following the support areas (3), which are the ends of the sleeper (1), and that are also equal in the two embodiments of the invention.

The central area (2) is where the geometry of the sleeper (1) brings greater novelty in the design with respect to sleepers already known in the art.

Next, by means of an imaginary route, starting at one of the outer areas (4) and ending in the center of the sleeper (1) of the invention, a description of the geometry of the sleeper (1) will be carried out through the description of the different cross sections that appear during the aforementioned imaginary route. In the different sections that appear in the figures, different polygons that are described below have been represented, in order to provide greater clarity to the same. The polygons must be understood as a representation for explaining the invention, but in reality they do not pose any real division in the cross sections described.

The geometry of the sleeper (1) in the two embodiments of the invention shows that, in the cross sections of the sleeper (1) (shown in FIGS. 4-7 and FIGS. 11-14), there are two differentiated parts, a first bottom section (5) in which the sleeper is formed by a first polygon (7) of, at least, 4 sides and a second top section (6), the geometry of which is detailed below.

Both the first bottom section (5) and the second top section (6) are solid thus resulting in a solid sleeper (1) in the two embodiments of the sleeper (1).

The first bottom section (5), in all the different cross sections of the sleeper (1) of the invention, is formed by a first polygon (7) of at least 4 sides (see FIGS. 4-7 and 11-14). The first polygon (7) is the same in the two different embodiments of the sleeper (1), although it should be noted that its dimensions are different in the different sections that are found in the imaginary route of the sleeper (1).

Figure 7:
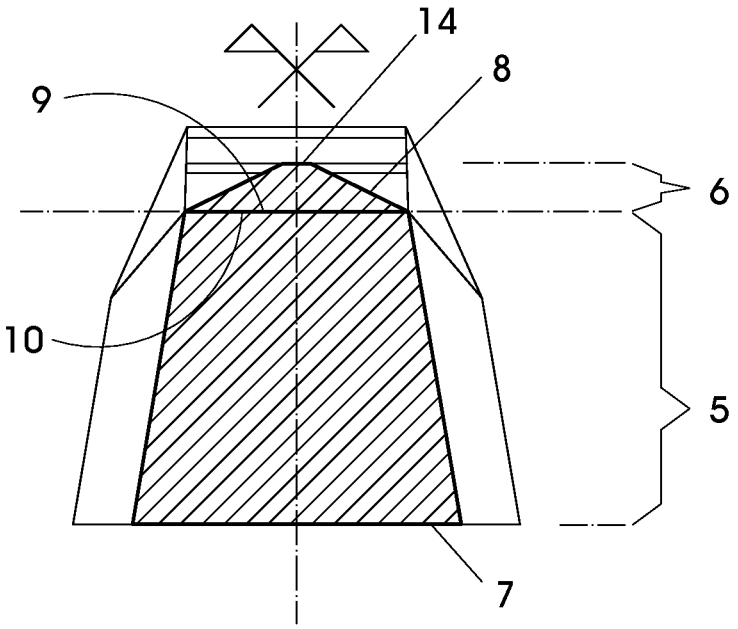
FIG. 7 is a view of a cross section carried out on the middle sector of the central area of the sleeper according to the first embodiment.
Figure 14:
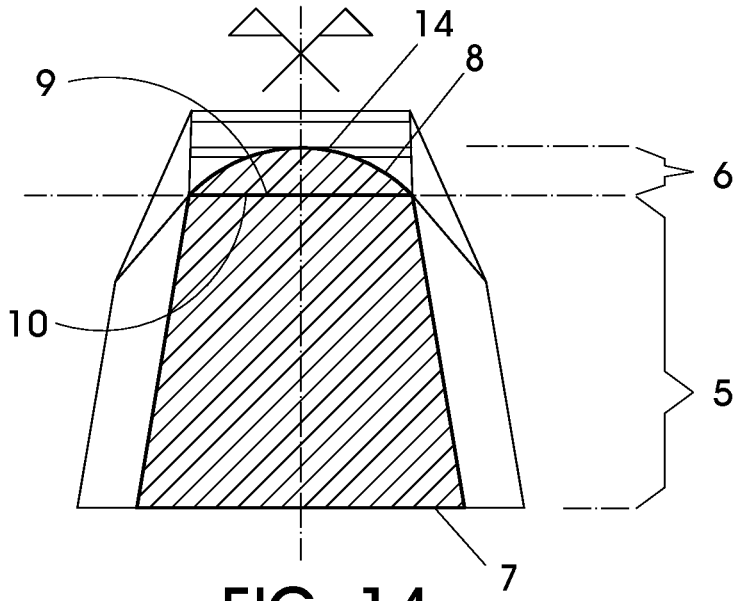
FIG. 14 is a view of a cross section carried out on the middle sector of the central area of the sleeper according to the second embodiment.

The second top section (6) in which the cross-section of the sleeper is divided in the development of this specification, is different depending if it is at the central area (2), at the support areas (3) or at the outer area (4) of the sleeper (1) (see FIGS. 4-7 and 11-14):

- at the outer areas (4) of the sleeper (1) the second top section (6) is formed by a second polygon (8) of "n" sides, "n" being≥4 (see FIG. 4 for the first embodiment and FIG. 11 for the second embodiment),
- at the support areas (3) of the sleeper (1), the second top section (6) is formed by a second polygon (8) of "n" sides, "n" being≥4 (see FIG. 5 for the first embodiment and FIG. 12 for the second embodiment),
- at the central area (2) of the sleeper (1), two sectors are identified, one middle sector (2*a*) and one end sector (2*b*), in which two different cross sections generated because the second top section (6) is different according to the section in which it is located, appear:
  - at the end sector (2*b*), the second top section (6) is formed by two polygons, the second polygon (8) of at least 4 sides, and over the second polygon there is a third polygon (12) of "m" sides, "m" being≥4 (see FIG. 6 for the first embodiment and FIG. 13 for the second embodiment).
  - at the middle sector (2*a*), the second top section (6) is formed by a second polygon (8) of "n" sides, "n" being≥4 (see FIG. 7 for the first embodiment and FIG. 14 for the second embodiment).

The first bottom section (5) and the second top section (6) are attached and the top base (10) of the first polygon (7) and the bottom base (9) of the second polygon (8) share their sides.

As already mentioned, the two different embodiments of the sleeper (1) are obtained by changing the geometry of the second top section (6) which is part of the cross-section of the central area (2). In the following, the geometries of the two embodiments of the sleeper (1) are identified, according to the geometry of the two sectors (2*a*, 2*b*) that make up the central area (2) of the sleeper (1).

In the first embodiment, in the middle sector (2*a*) of the central area (2) (see FIG. 7), the second top section (6), comprises a second polygon (8) having "n" sides, "n" being≥4; in the end sector (2*b*) of the central area (2) (see FIG. 6) the second top section (6), comprises two polygons: a second polygon (8) having "n" sides, "n" being≥4, and a third polygon (12) of "m" sides, "m" being≥4, located over the aforementioned second polygon (8), the bottom base (9') of the third polygon being located over the center of the top base (10') of the second polygon (8). In this first embodiment the top sides (14') of the third polygon (12) of the end sector (2*b*), (see FIG. 6) appear longitudinally in the sleeper (1) as a continuation of the top sides (14) of the second polygon (8) of the middle sector (2*a*), (see FIG. 7) such that there is continuity at the top surface of the sleeper (1) in the central area (2). See in FIG. 1 the evolution of the geometry of the sleeper (1) along its central area (2).

In the second embodiment, in the middle sector (2*a*) of the central area (2) (see FIG. 14), the second top section (6), has a conic section shape, assimilating said conic section shape as a second polygon (8) of "n" sides with "n" tending to infinity; in the end sector (2*b*) of the central area (2) (see FIG. 13) the second top section (6) comprises two different shapes: a second polygon (8) having at least 4 sides, and a conic section shape that is assimilated to a third polygon (12) of "m" sides, "m" tending to infinity, located over the aforementioned second polygon (8), the bottom base (9') of the third polygon (12) being located over the center of the top base (10') of the second polygon (8). In the second embodiment, the conic section shape of the end sector (2*b*) (see FIG. 13), appears longitudinally in the sleeper (1) as a continuation of the conic section shape of the middle sector (2*a*), (see FIG. 14) such that there is continuity at the top surface of the sleeper (1) in the central area (2). See in FIG. 8 the evolution of the geometry of the sleeper (1) along its central area (2).

The conic section profile of the second polygon (8) and of the third polygon (12) comprise circular section profile, parabolic section profile, hyperbolic section profile and ellipsoidal section profile.

Figure 2:
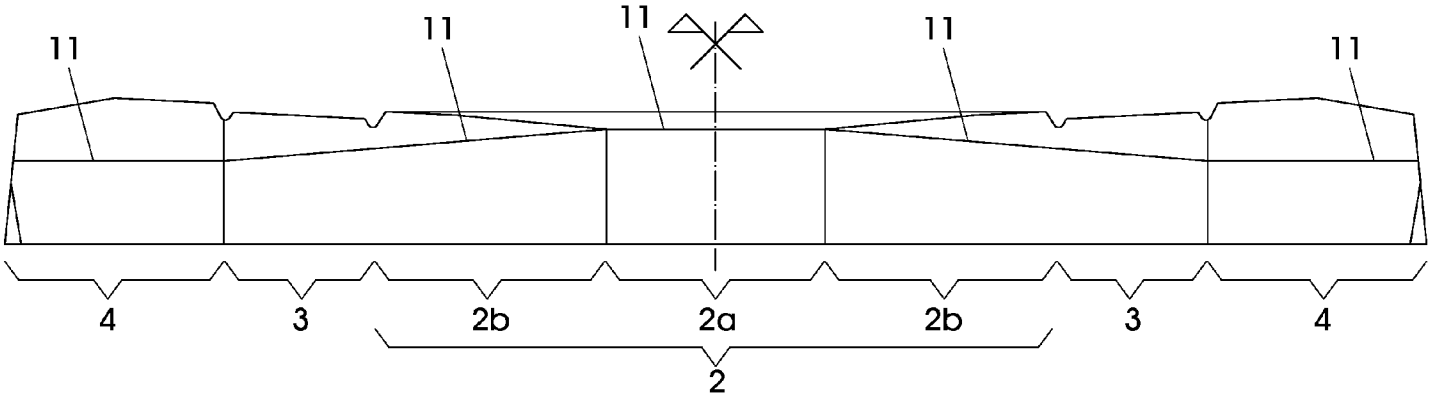
FIG. 2 is an elevation of the sleeper according to the embodiment of FIG. 1.
Figure 9:
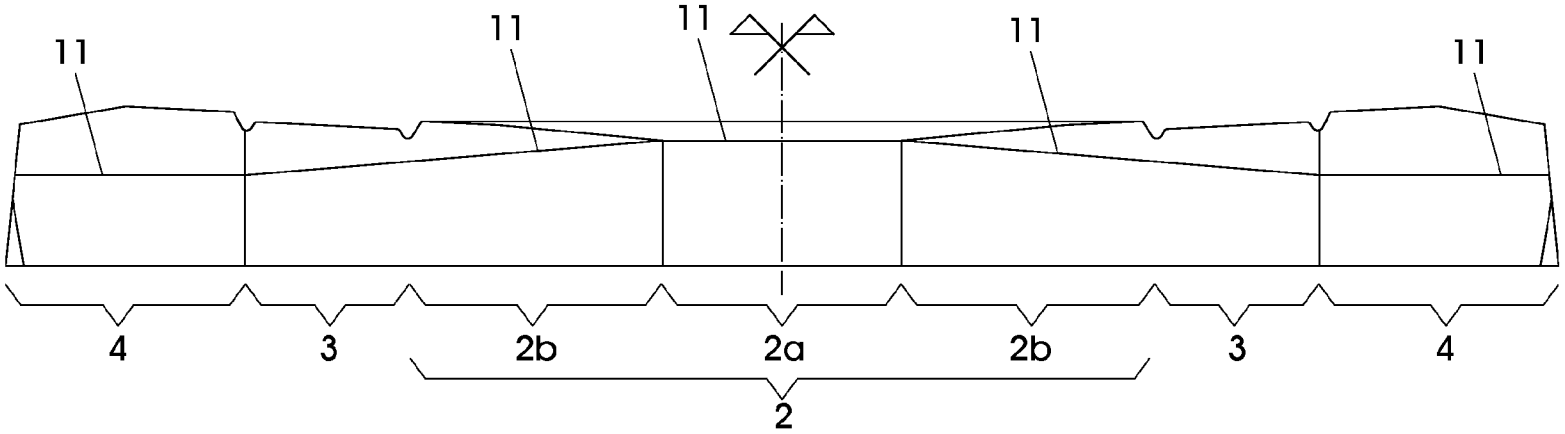
FIG. 9 is an elevation of the sleeper according to the embodiment of FIG. 8.

The change of the first bottom section (5) to the second top section (6) is marked longitudinally in the sleeper by a line (11) (see FIGS. 2 and 9) that changes its inclination according to its location in the three areas identified in the sleeper in the following manner:

- at the outer areas (4), the line (11) is horizontal;
- at the support areas (3), the line (11) is inclined gaining height from the end of the sleeper (1) towards the center;
- at the central area (2), the line (11) is horizontal in the middle sector (2*a*) of the central area (2) and in the end sector (2*b*) of the central area (2) the line (11) continues with the inclination that it acquired in the support areas.

The plants in the two embodiments of the sleeper (1) (shown in FIGS. 3 and 10) are identical, except in the central area (2) of the sleeper (1) due to the existence of the polygonal profile of the first embodiment against the conic section profile of the second embodiment. Considering the three aforementioned areas (outer, support and central), it is noted that on the outer area (4), the sleeper (1) has a greater width, and there is a narrowing from the beginning of the support area (3) to the middle sector (2*a*) of the central area (2), i.e. the narrowing is carried out in the support areas (3) and in the end sector (2*b*) of the central area (2).

The plant of the sleeper (1) is defined as described below: on the outer area (4) the sleeper has a width, on the middle sector (2*a*) of the central area (2) it has a smaller width and there is a transition area that encompasses the support area (3) and the end sector (2*b*) of the central area, in which the variation of the width occurs in a linear way.

The novel geometry of the central area (2) of the sleeper (1) aims to reduce the speed of the wind at the height of the ballast in the area between sleepers (velocity field between sleepers) when there is the passage of a railway vehicle at high speed. This geometry is also intended to minimize the possibility of individual stones that form the ballast to settle on the sleeper (1), reducing the likelihood of a stone being placed on the sleeper (1) due to the passage of a railway vehicle, and subsequently the stone being thrown with the passage of other railway vehicles.

The reduction of the velocity field between sleepers (1) is obtained, as already indicated, by modifying the geometry of the sleeper (1) in the area between the rails (13) that form the track of the train; thus a sleeper (1) with a profile as the one that can be seen in FIG. 1, in a first embodiment, or as the one seen in FIG. 8, in a second embodiment, is obtained.

The faces of the sleeper (1) are not vertical, since there is at least one inclination in all of the faces, starting in the lowest part of the sleeper (1), the one closest to the ground plane, in a plane far away from the center of the sleeper (1) and at the top of the sleeper (1) at a plane closer to the center of the sleeper (1).

Figure 15:
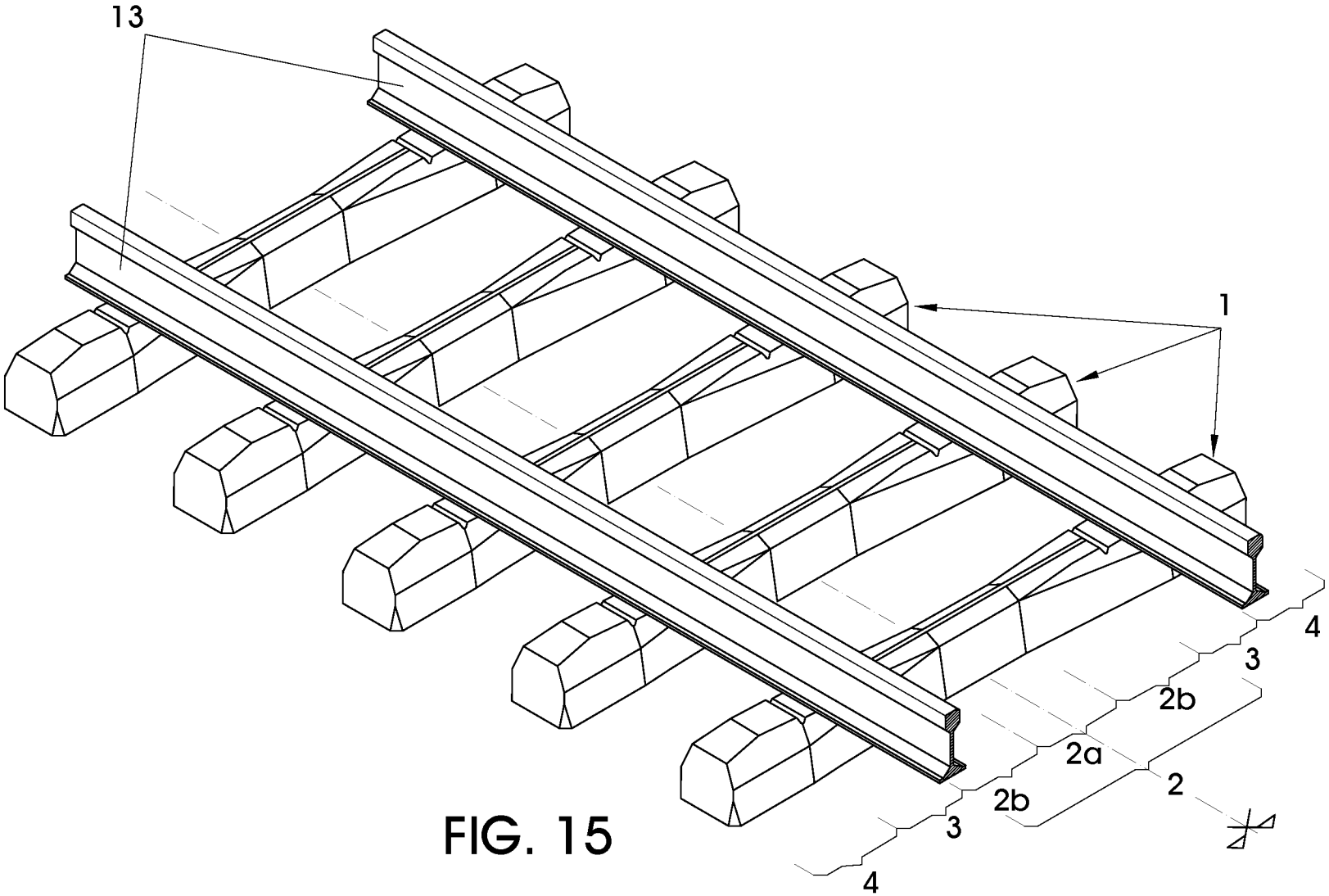
FIG. 15 is a section of a track consisting of trapezoidal sleepers as the one of the invention and rails already installed on the sleepers.
Figure 16:
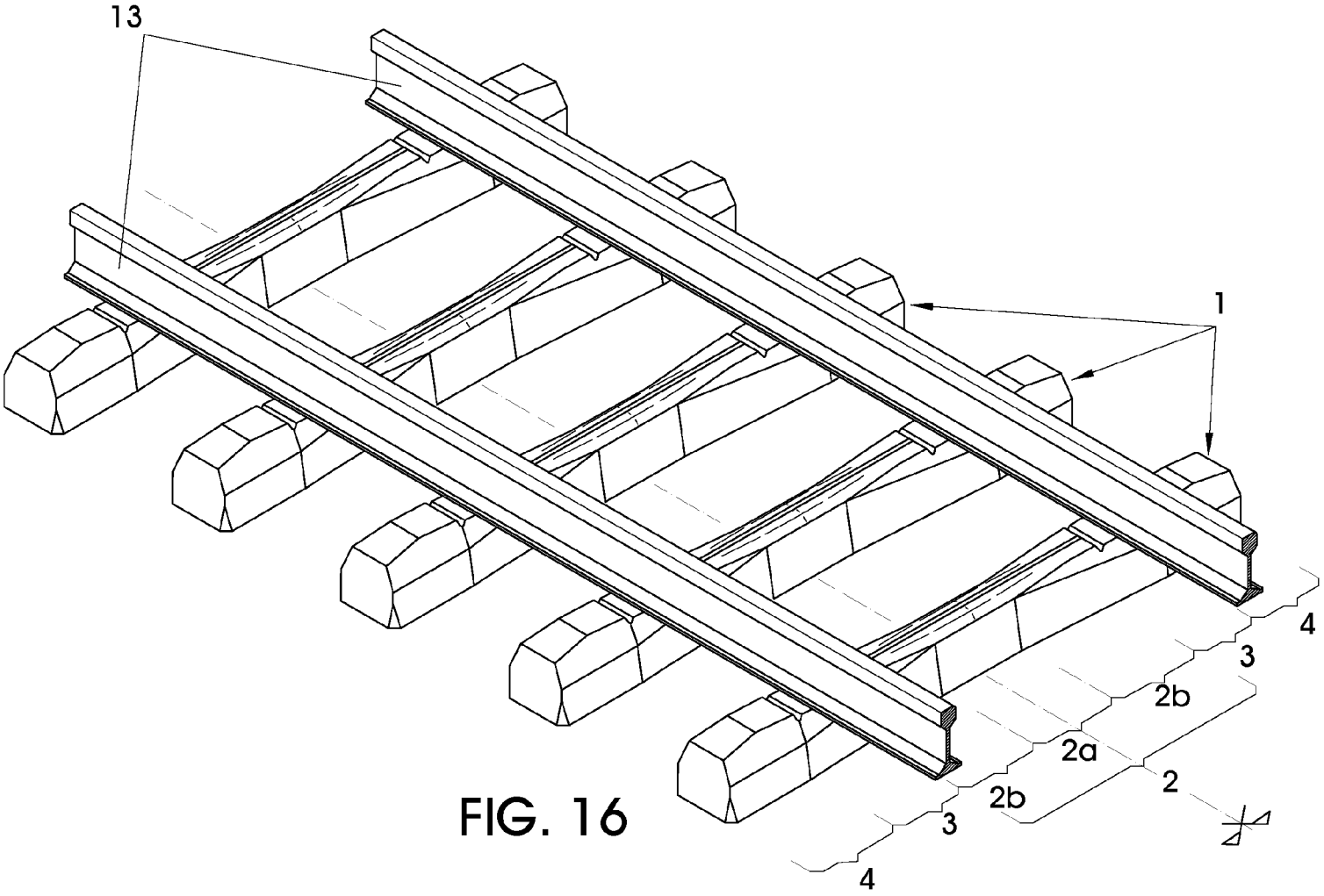
FIG. 16 is a section of a track consisting of cylindrical sleepers as the one of the invention and rails already installed on the sleepers.

FIGS. 15 and 16 show a small section of track, composed by the sleepers with the two rails (13) of the track installed on the cited sleepers (1).

The invention should not be limited to the particular embodiment described in this document. The persons skilled in the art can develop other embodiments in view of the description carried out herein. As a result, the scope of the invention is defined by the following claims.

The invention claimed is:

1. High-speed railway aerodynamic sleeper comprising:

a central area;

two support areas, on each side of the central area, on which rails are placed;

two outer areas, located at outer ends of the support areas, respectively, wherein a cross-section of the sleeper comprises:

a solid first bottom section, comprising a first polygon having at least four sides;

a solid second top section comprising a second polygon having at least four sides, wherein the first bottom section and the second top section are attached to each other, such that a top base of the first polygon and a bottom base of the second polygon share their sides;

wherein the central area comprises a middle sector constituting the center of the sleeper, and two end sectors at opposite sides of the middle sector, wherein in the middle sector of the central area, a cross section through the second top section includes one second polygon of infinite sides;

wherein a cross section through each of the end sectors of the central area comprises a second polygon having at least four sides and a third polygon of infinite sides located over the second polygon, and thus having a conic section profile.

2. The high-speed railway aerodynamic sleeper, according to claim 1, wherein, on the top section, the top sides of the second polygon of the middle sector of the central area are a continuation of the top sides of the third polygon in the end sector of the central area, having continuity at the outer surface provided by the third polygon and the second polygon.

3. The high-speed railway aerodynamic sleeper, according to claim 1, wherein there is a line, longitudinally, in the sleeper that marks a transition between the first bottom section and the second top section and the inclination of the line varies according to the line location in relation to the central area, the two support areas and the two outer areas.

4. The high-speed railway aerodynamic sleeper, according to claim 1, wherein the sleeper is made of concrete.

5. The high-speed railway aerodynamic sleeper, according to claim 1, wherein the sleeper is made of composite materials.

6. The high-speed railway aerodynamic sleeper, according to claim 2, wherein the sleeper is made of concrete.

7. The high-speed railway aerodynamic sleeper, according to claim 2, wherein the sleeper is made of composite materials.

* * * * *